US007969406B2

(12) United States Patent
Park

(10) Patent No.: US 7,969,406 B2
(45) Date of Patent: Jun. 28, 2011

(54) BACKLIGHT DRIVING SYSTEM FOR A LIQUID CRYSTAL DISPLAY DEVICE

(75) Inventor: Jung Kook Park, Yongin-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 1057 days.

(21) Appl. No.: 11/806,732

(22) Filed: Jun. 4, 2007

(65) Prior Publication Data

US 2007/0279376 A1 Dec. 6, 2007

(30) Foreign Application Priority Data

Jun. 5, 2006 (KR) ..... 10-2006-0050480

(51) Int. Cl.
*G09G 3/36* (2006.01)

(52) U.S. Cl. ..... 345/102; 345/204; 345/211

(58) Field of Classification Search ..... 345/102, 345/87–89, 76–83, 204, 211; 349/61, 69–70
See application file for complete search history.

(56) References Cited

U.S. PATENT DOCUMENTS

| | | | | |
|---|---|---|---|---|
| 6,169,528 | B1 * | 1/2001 | Oguchi et al. | 345/74.1 |
| 6,191,534 | B1 * | 2/2001 | Schuler et al. | 315/169.3 |
| 6,724,354 | B1 * | 4/2004 | Spitzer et al. | 345/32 |
| 7,157,866 | B2 * | 1/2007 | Komiya et al. | 315/312 |
| 7,495,397 | B2 * | 2/2009 | Okabe | 315/169.1 |
| 7,508,143 | B2 * | 3/2009 | Suzuki | 315/291 |
| 7,511,695 | B2 * | 3/2009 | Furukawa et al. | 345/102 |
| 2002/0159002 | A1 * | 10/2002 | Chang | 349/61 |
| 2004/0252096 | A1 * | 12/2004 | Wang et al. | 345/102 |
| 2005/0200312 | A1 * | 9/2005 | Komiya et al. | 315/291 |
| 2005/0231459 | A1 | 10/2005 | Furukawa | |
| 2007/0228504 | A1 * | 10/2007 | Suzuki | 257/443 |
| 2007/0229450 | A1 * | 10/2007 | Suzuki | 345/102 |

FOREIGN PATENT DOCUMENTS

| | | |
|---|---|---|
| KR | 10-2005-0115043 | 12/2005 |
| KR | 10-2006-0045573 A | 5/2006 |

OTHER PUBLICATIONS

Ogawa et al. SID (Society for Information Display), 1999, Digest, pp. 1098-1101, "Field-Sequential-Color LCD Using Switched Organic EL Backlighting".*

* cited by examiner

*Primary Examiner* — Alexander Eisen
*Assistant Examiner* — Jason M Mandeville
(74) *Attorney, Agent, or Firm* — Lee & Morse, P.C.

(57) ABSTRACT

A backlight driving system for a backlight unit for a liquid crystal display device using a field sequential driving scheme, the backlight unit including a plurality of first color (C1), second color (C2), and third color (C1) organic light emitting diodes (OLEDs), a first switch unit including first, second and third color switches, the first switch unit adapted to supply one of a first voltage and a ground voltage to cathodes of respective C1, C2 and C3 OLEDs, and a light source controller adapted to supply independent first, second and third color second voltages to anodes of respective C1, C2 and C3 OLEDs.

14 Claims, 2 Drawing Sheets

BACKLIGHT DRIVING SYSTEM FOR A LIQUID CRYSTAL DISPLAY DEVICE

BACKGROUND OF THE INVENTION

1. Field of the Invention

The present invention relates to a liquid crystal display device. More particularly, the present invention relates to a backlight driving system for a liquid crystal display device that does not include a color filter.

2. Description of the Related Art

Recently, as personal computers, televisions, and the like become lighter and thinner, a display device for use in such devices has also been demanded to be lighter and thinner. To meet such demands, flat panel displays (FPDs), such as liquid crystal displays (LCDs), have been developed to replace cathode ray tubes (CRTs).

An LCD device is a FPD obtaining a desired image signal by applying electric field to a liquid crystal, having an anisotropic dielectric constant, between two substrates, and controlling the amount of light transmitted from an external light source (a backlight unit) to the substrates by controlling the intensity of the electric field.

In general, a conventional LCD device displays color images using a color filter scheme. The color filter scheme may include providing a color filter layer for each of the three primary colors, i.e., red R, green G and blue B, on one of two substrates. In transmitting light from a single light source into the R, G and B color filter layers, the LCD device may display a desired color by controlling the amount of light transmitted into the R, G and B color filter layers, and compositing the R, G and B colors.

However, the conventional LCD device using such a color filter scheme may have a number of disadvantages. For example, since the light transmittance of the color filter is a maximum of about 33% or less, loss of light output from the color filter is significant, thereby decreasing brightness. In order to increase brightness, a backlight unit should be made brighter, thereby increasing power consumption. Finally, the color filter is very expensive compared with other parts of the LCD device, thereby increasing production cost.

SUMMARY OF THE INVENTION

The present invention is therefore directed to a backlight driving system for a liquid crystal display (LCD) device, which substantially overcomes one or more of the problems due to the limitations and disadvantages of the related art.

It is therefore a feature of an embodiment of the present invention to provide a backlight driving system for an LCD device that allows color images to be realized without the use of a color filter.

It is therefore another feature of an embodiment of the present invention to provide a backlight driving system for an LCD device using a field sequential driving scheme using organic light emitting diodes (OLEDs) outputting light at different wavelengths as light sources for a backlight unit, and providing separate power sources for the respective OLEDs to control the sequential turn on/off thereof.

At least one of the above and other features and advantages of the present invention may be realized by providing a backlight driving system for driving a backlight unit for a liquid crystal display device using a field sequential driving scheme, the back light unit including a plurality of first color (C1), second color (C2), and third color (C3) organic light emitting diodes (OLEDs), the backlight driving system including a first switch unit including a first color switch, a second color switch and a third color switch, the first switch unit adapted to supply one of a first voltage and a ground voltage to cathodes of respective C1, C2 and C3 OLEDs, and a light source controller adapted to supply independent second voltages, including a first color second voltage, a second color second voltage and a third color second voltage, to anodes of respective C1, C2 and C3 OLEDs.

Each of the first, second and third color switches may include a pair of switches to select one of the first voltage and the ground voltage.

The light source controller may include a plurality of resistors R2, R3 and R4 connected in parallel, and a second switch unit adapted to respectively connect various ones of the plurality of resistors to supply independent first, second and third second voltages to the anodes of the respective C1, C2 and C3 OLEDs. Control signals C1_ON/OFF, C2_ON/OFF and C3_ON/OFF, which control the turn on/off of the respective switches included in the first switch unit and the second switch unit, may be simultaneously applied to the first switch unit and the second switch unit.

The light source controller may include a DC/DC converter. The DC/DC converter may include a power source voltage booster adapted to boost the input voltage, a controller adapted to set and store the boosted input voltage as a reference voltage, a voltage divider adapted to divide the reference voltage into a plurality of output voltages, a first output stage adapted to supply the divided output voltages to the anode of an OLED, and a second output stage adapted to supply the divided output voltages to the first switch unit connected with the cathode of the OLED.

The voltage divider may include a first resistor R1 provided between a first node N1, connected with the first and second output stages, and a second node N2, connected with a feedback terminal of the controller, and a second resistor R2, a third resistor R3 and a fourth resistor R4 provided between the first resistor R1 and the ground power source and connected in parallel with each other. The voltage divider may include a second color second switch between the second resistor R2 and the ground power source to output a power source voltage supplied to the anode of the C2 OLED, and a first color second switch between the third resistor R3 and the ground power source to output a power source voltage supplied to the anode of the C1 OLED.

The power source voltage booster may include an inductor and a diode connected in series. The controller may receive an input to the inductor and an output from the inductor.

The light source controller may be further adapted to supply independent first, second and third color second voltages to the first switch unit as the first voltage. When a selected OLED of the C1, C2 and C3 OLEDs is to emit light, the first switch unit may be adapted to supply the ground voltage to the cathode of the selected OLED. The first color C1 may be red, the second color C2 may be green, and the third color C3 may be blue.

At least one of the above and other features and advantages of the present invention may be realized by providing a backlight system, including a backlight unit a plurality of first color (C1), second color (C2), and third color (C3) organic light emitting diodes (OLEDs), a first switch unit including a first color switch, a second color switch and a third color switch, the first switch unit adapted to supply one of a first voltage and a ground voltage to cathodes of respective C1, C2 and C3 OLEDs, and a light source controller adapted to supply independent second voltages, including a first color second voltage, a second color second voltage and a third color second voltage, to anodes of respective C1, C2 and C3 OLEDs.

At least one of the above and other features and advantages of the present invention may be realized by providing a liquid crystal display (LCD) device, including a liquid crystal panel, and a backlight system adjacent the liquid crystal panel, the back light system including a backlight unit including a plurality of first color (C1), second color (C2), and third color (C3) organic light emitting diodes (OLEDs), a first switch unit including a first color switch, a second color switch and a third color switch, the first switch unit adapted to supply one of a first voltage and a ground voltage to cathodes of respective C1, C2 and C3 OLEDs, and a light source controller adapted to supply independent second voltages, including a first color second voltage, a second color second voltage and a third color second voltage, to anodes of respective C1, C2 and C3 OLEDs.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
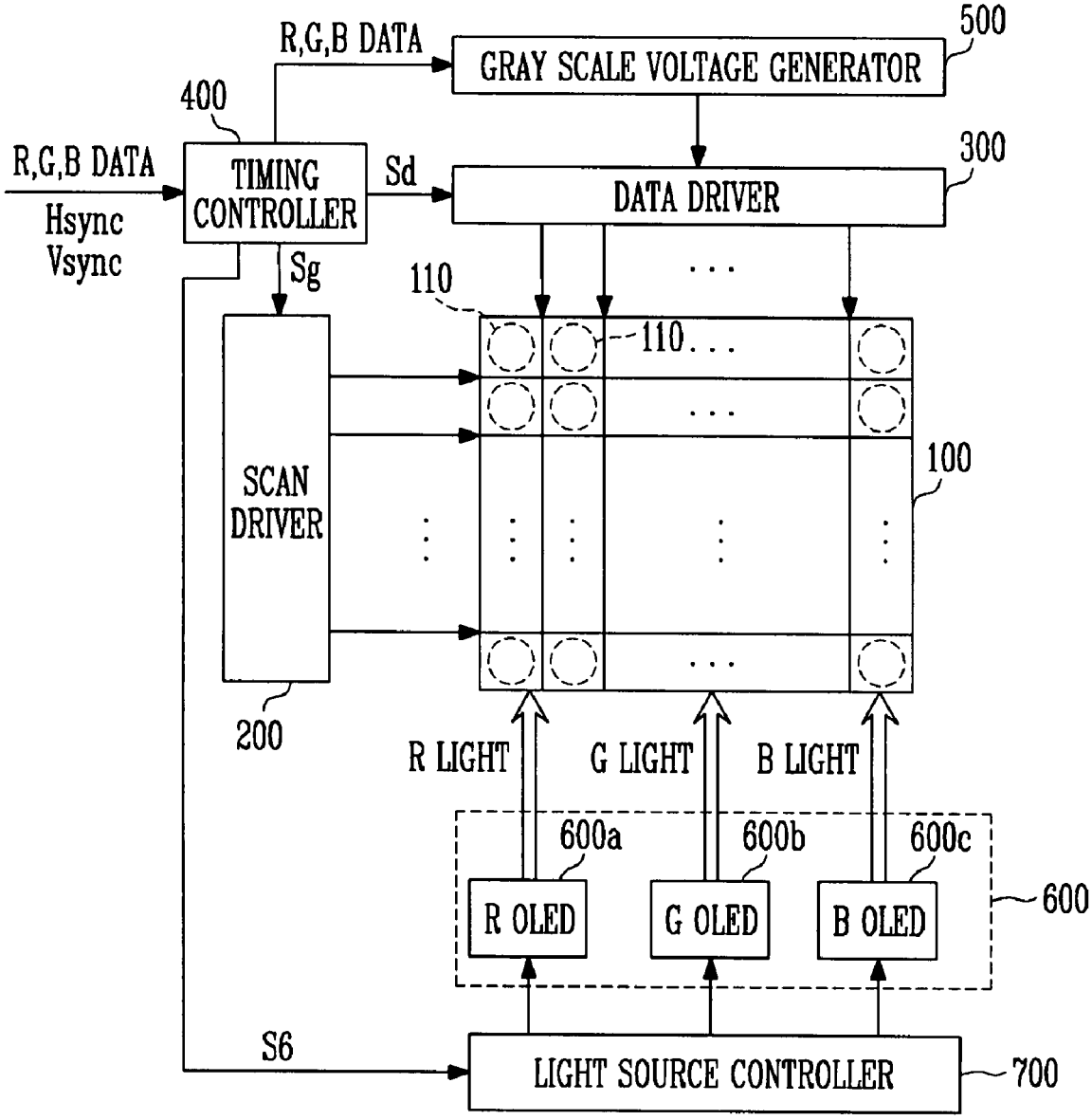
FIG. 1 illustrates a block diagram of an LCD device according to an embodiment of the present invention.

Korean Patent Application No. 2006-0050480, filed on Jun. 5, 2006, in the Korean Intellectual Property Office, and entitled: "Backlight Driving System for Liquid Crystal Display Device," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

In order to overcome one or more of the disadvantages as described above, an LCD device may use a field sequential driving scheme capable of implementing full-color without a color filter.

The LCD device using the field sequential driving scheme may include independent light sources for each R, G and B color in a backlight unit, and may obtain a full-color image by sequentially and periodically lighting the light sources, and adding a color signal corresponding to each pixel synchronizing with their lighting period.

In other words, according to the LCD device using the field sequential driving scheme, a color image may be displayed using an afterimage effect of an eye by time-divisionally and sequentially displaying the three primary colors, i.e., R, G and B, of light output from corresponding light sources in the backlight unit in one pixel, without dividing one pixel into R, G and B unit pixels.

Such field sequential driving schemes may be classified as an analog driving scheme and a digital driving scheme.

The analog driving scheme sets a plurality of gray scale voltages corresponding to a number of gray scales to be displayed, selects one of the gray scale voltages corresponding to gray scale data, and drives a liquid crystal panel with the gray scale voltage selected. Thus, gray scale expression is realized in accordance with a transmitted amount of light.

The digital driving scheme sets a driving voltage applied to the liquid crystal constant and controls a voltage application time to realize gray scale expression. Thus, gray scale expression is realized by controlling an accumulated amount of light transmitted to the liquid crystal.

The field sequential driving scheme may have an R field interval representing red (R), a G field interval representing green (G), and a B field interval representing blue (B). In each interval, a R light-emitting light source for emitting red light, a G light-emitting light source for emitting green light and a B light-emitting light source for emitting blue light may be sequentially turned on. In the interval where the respective light sources emit light, a color image may be displayed with light accumulated by providing R, G and B light to the liquid crystal.

Embodiments of the present invention relate to a backlight driving system for an LCD device using a field sequential driving scheme implemented to use red (R), green (G) and blue (B) organic light emitting diodes (OLEDs) as a light source for a backlight unit, and providing separate power sources for the respective R, G and B OLEDs to control color coordinates and brightness of the respective OLEDs, and the sequential turn on/off the respective R, G and B OLEDs.

Hereinafter, the embodiments of the present invention will be described in more detail with reference to the accompanying drawings.

FIG. 1 illustrates a block diagram of an LCD device according to an embodiment of the present invention using a field sequential driving scheme. The LCD device may include an LCD panel 100, a scan driver 200, a data driver 300, a gray scale voltage generator 500, a timing controller 400, and a backlight unit 600.

The backlight unit 600 may include a plurality of OLEDs 600*a*, 600*b*, and 600*c* outputting R, G and B light, respectively. The respective R, G and B OLEDs in the backlight unit 600 may be provided with separate power sources for controlling the color coordinate and brightness of the respective OLEDs. A light source controller 700 for controlling the sequential turn on/off of the respective R, G and B OLEDs may also be employed The LCD panel 100 may be formed with a plurality of scan lines for transferring gate on signals and a plurality of data lines, isolated from and intersected with the plurality of the scan lines, for transferring gray scale voltages corresponding to predetermined gray data. Each pixel of a plurality of pixels 110 arranged in a matrix may be defined by a scan line and a data line. Each pixel 110 may include a thin film transistor (TFT) (not shown) having its gate electrode and source electrode connected with the scan line and the data line, respectively, a pixel capacitor (not shown), connected with the drain electrode of the TFT, and a storage capacitor (not shown).

The scan driver 200 may sequentially apply scan signals to the scan lines to turn on the TFT having its gate electrode connected with the scan line to which the scan signal is applied.

The timing controller 400 may receive gray scale data signals R, G and B DATA, a horizontal synchronous signal Hsync, and a vertical synchronous signal Vsync to supply control signals Sg, Sd, and Sb to the scan driver 200, the data driver 300 and/or the light source controller 700, respectively, and supply gray scale data R, G and B DATA to the gray scale voltage generator 500.

The gray scale voltage generator 500 may generate a gray scale voltage corresponding to the gray scale data, and may supply the gray scale voltage to the data driver 300. The data driver 300 may apply the gray scale voltage output from the gray scaly voltage generator 500 to the corresponding data line.

The respective R, G and B OLEDs included in the backlight unit 600 may output corresponding R, G and B light to the LCD panel 100. The light source controller 700 may include separate power sources for the respective R, G and B OLEDs to control the color coordinates and brightness of the respective OLEDs, and the sequential turn on/off of the respective R, G and B OLEDs. Supplying the gray scale voltage from the data driver 300 to the data line and lighting the R, G and B OLEDs by the light source controller 700 may be synchronized by the control signal supplied from the timing controller 500.

The embodiment of the present invention uses an OLED, which is self-luminous and emits light by photoluminescence by recombining electrons and holes, as a light source for the backlight unit 600.

An OLED may include an organic emission film between two electrodes, i.e., an anode and a cathode. The organic emission film may include multi-layers stacked with a hole transport layer, an emission film, an electron transport layer, or the like, to transport electrons and holes, and to emit light, thereby improving the balance of electrons and holes to enhance emission efficiency. Further, the organic emission film may also include separate electron injection and hole injection layers. That is, each of the anode and the cathode in the OLED may have a predetermined voltage applied thereto to inject the holes and the electrons into the organic emission film and then recombine them, thereby generating excitons. When the excitons decay, light having a specified wavelength is emitted due to photoluminescence.

Figure 2:
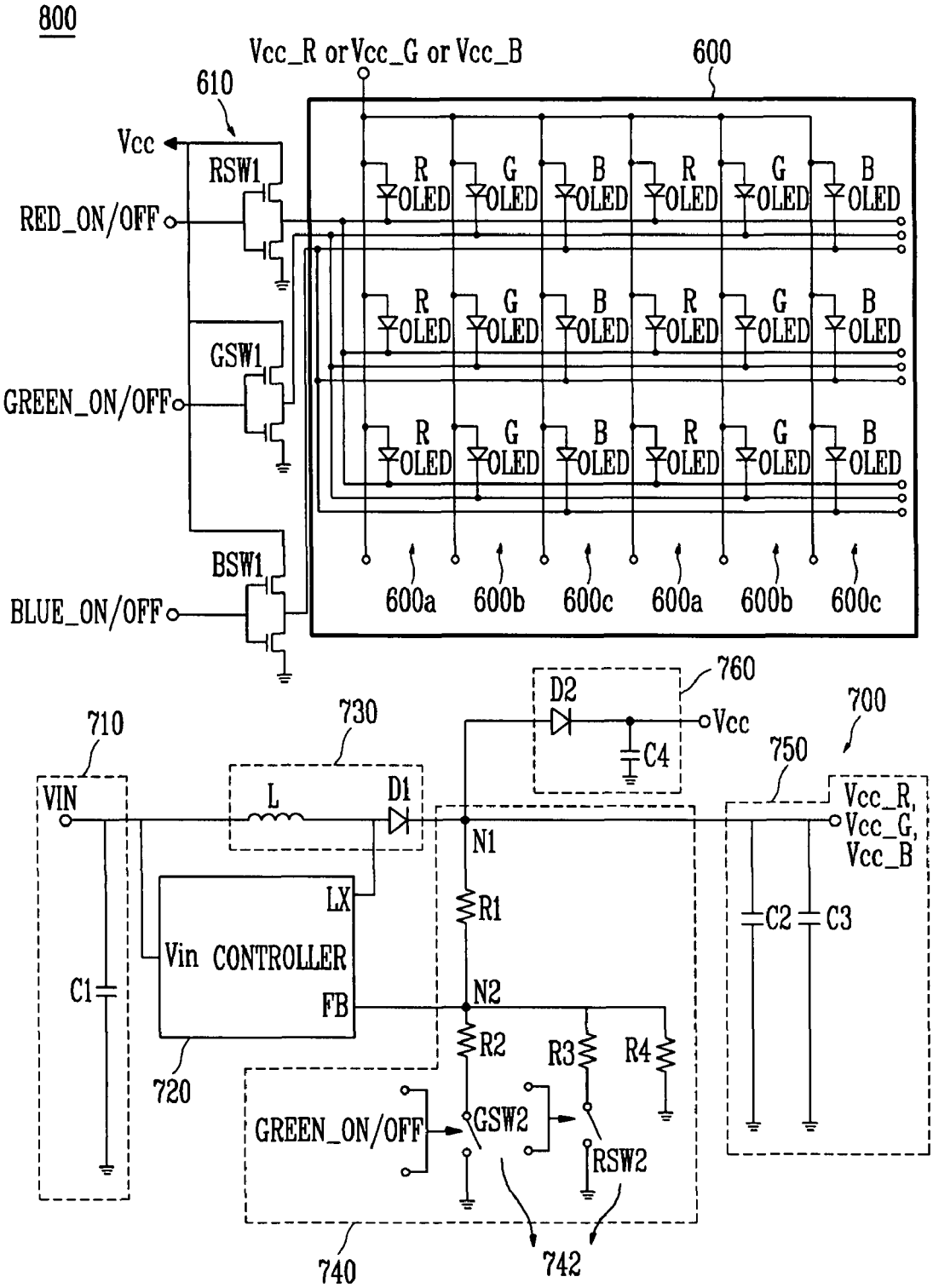
FIG. 2 illustrates a circuit diagram of a backlight driving system for an LCD device according to an embodiment of the present invention.

FIG. 2 illustrates a circuit diagram of a backlight driving system 800 for an LCD device according to an embodiment of the present invention.

The backlight driving system 800 may include a plurality of R, G and B OLEDs 600*a*, 600*b* and 600*c*, and the light source controller 700 for driving the plurality of OLEDs, as shown in FIG. 2

Referring to FIG. 2, the backlight driving system 800 may include a first switch unit 610, including switches RSW1, GSW1 and BSW1, connected with the cathodes of the respective R, G and B OLEDs to supply either a first voltage VCC or a ground voltage GND to the cathodes of the respective R, G and B OLEDs. Each switch RSW1, GSW1 and BSW1 of the first switch unit 610 may be implemented as a pair of switches to select either the first voltage VCC or the ground voltage GND.

The light source controller 700 may supply independent second voltages VCC_R, VCC_G, and VCC_B to the anodes of the R, G and B OLEDs. The light source controller 700 may include a plurality of resistors R2, R3 and R4 connected in parallel, and a second switch unit 742, including switches RSW2 and GSW2, selecting the connection of the resistors, in order to supply independent second voltages VCC_R, VCC_G and VCC_B to the anodes of the respective R, G and B OLEDs.

Control signals RED_ON/OFF, Green_ON/OFF and Blue_ON/OFF, which control the turn on/off of the respective switches included in the first switch unit 610 and the second switch unit 742, may be simultaneously applied to the first switch unit 610 and the second switch unit 742, wherein these control signals may be supplied through the timing controller 400 shown in FIG. 1. The light source controller 700 may be a DC/DC converter.

The light source controller 700 may include an input power source unit 710 transferring an input voltage Vin; a power source voltage booster 730 boosting the input voltage; a controller 720 setting and storing the boosted input voltage as a reference voltage Vref; a voltage divider 740 dividing the reference voltage into a plurality of output voltages; a first output stage 750 supplying the divided output voltages to the anodes of the OLEDs in the backlight unit; and a second output stage 760 supplying the divided output voltages to the first switch unit 610 connected with the cathodes of the OLEDs.

The input power source unit 710 may include a first capacitor C1 to transfer the input voltage Vin. The power source voltage booster 730 may boost the power of the input voltage Vin transferred from the input power source unit 710 to a predetermined reference level. The power source voltage booster 730 may include an inductor L and a diode D1.

A first electrode of the inductor L may be connected with the first input power source unit 710 and the input power source terminal VIN of the controller 720, and a second electrode of the inductor L may be connected with an input terminal LX of the controller 720, in order to form a closed loop. Therefore, current from the input power source may be stored in the inductor L.

A first electrode of the diode D1, i.e., the anode, may be connected with the second electrode of the inductor L as shown, and the second electrode of the diode, i.e., the cathode, may be connected with a first node N1 connected with the first and second output stages 750 and 760. The diode D1 may rectify the voltage boosted by the inductor L. The first and second output stages 750 and 760 may include capacitors C2, C3 and C4 to stabilize the output voltage. The second output stage 760 may also include a diode D2.

The voltage divider 740 may include a first resistor R1 provided between the first node N1, which is connected with the first and second output stages 750 and 760, and a second node N2, which is connected with a feedback terminal FB of the controller 720, and the second resistor R2, the third resistor R3 and the fourth resistor R4 connected in parallel, and provided between the first resistor R1 and the ground power source GND.

In the second switch unit 742, the GREEN switch GSW2 may be provided between the second resistor R2 and the ground power source GND to output a power source voltage to be supplied to the anode of the G OLED, and the RED switch RSW2 may be provided between the third resistor R3 and the ground power source GND to output a power source voltage supplied to the anode of the R OLED.

The operation of the backlight driving system for the LCD device having the constitution as above will be described below. Since the LCD device is driven using the field sequential driving scheme, a plurality of the R, G and B OLEDs constituting the backlight unit may perform the on/off operations in sequence.

When the R OLED is turned on, the RED_ON signal, and the Green_OFF and the Blue_OFF signals, may be supplied to the first switch unit 610 and the second switch unit 742 from the timing controller 400 shown in FIG. 1. When the RED_ON signal, and the Green_OFF and Blue_OFF signals, are supplied to the second switch unit 742, the RED switch RSW2 of the second switch unit is turned on and the GREEN switch GSW2 is turned off.

Therefore, remaining resistors within the voltage divider 740, i.e., the first resistor R1, and the third and the fourth resistor R3 and R4, are connected in parallel, so that the reference voltage Vref on the second node N2 connected with the feedback terminal FB of the controller 720 is divided by the first, third and fourth resistances, resulting in a reference voltage on the first node N1 connected with the first and second output stages 750 and 760 equal to (R1/(R3+R4)+1)*Vref. That is, the (R1/(R3+R4)+1)*Vref is output as the reference voltage from the first and second output stages 750 and 760.

In other words, the (R1/(R3+R4)+1)*Vref becomes the second voltage VCC_R applied to the anode of the R OLED as described above. However, the voltage may be applied to the anodes of the G and B OLEDs, not just the R OLED.

Further, the voltage is supplied to the first switch unit 610 connected with the cathodes of the respective OLEDs as the first voltage VCC, as shown in FIG. 2. That is, in this case, the first voltage VCC is the same as the second voltage VCC_R. At this time, the RED_ON signal, and the GREEN_OFF and the BLUE_OFF signals, may also be supplied to the first switch unit 610. Therefore, the RED switch RSW1 of the first switch unit 610 may be connected with the ground power source GND, and the GREEN switch GSW1 and the BLUE switch BSW1 of the first switch unit may be connected with the first voltage VCC.

As a result, the anode of the R OLED of a plurality of the OLEDs included in the backlight unit 600 is supplied with the second voltage VCC_R and the cathode of the R OLED is supplied with the ground voltage GND, thus emitting a predetermined red light in response to this voltage difference. However, the anodes and the cathodes of the G and B OLEDs are supplied with the second voltage VCC_R and the first voltage VCC, which are equal, so no light is emitted therefrom.

This operation is equally applicable when the G OLEDs are turned-on. In other words, the GREEN_ON signal, and the RED-OFF and the BLUE_OFF signals are supplied to the first switch unit 610 and the second switch unit 742 from the timing controller 400 shown in FIG. 1. Therefore, the GREEN switch GSW2 of the second switch unit 742 is turned on, and the RED switch RSW2 is turned off.

As a result, remaining resistors within the voltage divider 740, i.e., the first resistor R1 and the second and the fourth resistor R2 and R4, are connected in parallel, so that the reference voltage Vref on the second node N2 connected with the feedback terminal FB of the controller 720 is divided by the first, second and fourth resistances, resulting in a reference voltage on the first node N1 connected with the first and second output stages 750 and 760 equal to (R1/(R2+R4)+1)*Vref. That is, the (R1/(R2+R4)+1)*Vref is output as the reference voltage from the first and second output stages.

In other words, the (R1/(R2+R4)+1)*Vref becomes the second voltage VCC_G applied to the anode of the G OLED as described above. However, the voltage may be applied to the anodes of the R and B OLEDs, not just the G OLED.

Further, the voltage is supplied to the first switch unit 610 connected with the cathode electrodes of the respective OLEDs as the first voltage VCC, as shown in FIG. 2. That is, in this case, the first voltage VCC is the same as the second voltage VCC_G.

At this time, the GREEN_ON signal, and the RED_OFF and the BLUE_OFF signals, are also supplied to the first switch unit 610. Therefore, the GREEN switch GSW1 of the first switch unit may be connected with the ground power source GND, and the RED switch RSW1 and the BLUE switch BSW1 of the first switch unit may be connected with the first voltage VCC.

As a result, the anode of the G OLED of a plurality of the OLEDs in the backlight unit 600 is supplied with the second voltage VCC_G and the cathode thereof is supplied with the ground voltage GND, thereby emitting a predetermined green light in response to this voltage difference. However, the anodes and the cathodes of the R and B OLEDs are supplied with the second voltage VCC_G and the first voltage VCC, i.e., having the same voltage values, so that light is not emitted therefrom.

When the B OLED is turned on, the BLUE_ON signal, and the RED_OFF and the GREEN_OFF signals are supplied to the first switch unit 610 and the second switch unit 742 from the timing controller 400 shown in FIG. 1.

Therefore, both of the RED switch RSW1 and the GREEN switch GSW2 of the second switch unit 742 are turned off. In accordance with the embodiment of the present invention shown in FIG. 2, the second switch 742 does not have a BLUE switch. Since the second switch unit 742 is provided to supply the independent power sources to the respective R, G and B OLEDs, which may be implemented without having three switches, here the BLUE switch may be omitted. In other words, although the BLUE switch is not provided, the same operation may be implemented by turning off the RED switch RSW2 and the GREEN switch GSW2.

As a result, remaining resistors within the voltage divider 740, i.e., the first resistor R1 and the fourth resistor R4, are connected in parallel, so that the reference voltage Vref on the second node N2 connected with the feedback terminal FB of the controller 720 is divided by the first and fourth resistances, resulting in a reference voltage on the first node N1 connected with the first and second output stages 750 and 760 equal to (R1/R4+1)*Vref. That is, the (R1/R4+1)*Vref is output as the reference voltage from the first and second output stages 750 and 760.

In other words, the (R1/R4+1)*Vref becomes the second voltage VCC_B applied to the anode electrode of the B OLED as described above. However, the voltage may be applied to the anode electrodes of the G and R OLEDs, not just the B OLED.

Further, the voltage is supplied to the first switch unit 610 connected with the cathode electrodes of the respective OLEDs as the first voltage VCC, as shown in FIG. 2. That is, in this case, the first voltage VCC is the same as the second voltage VCC_B.

At this time, the BLUE_ON signal, and the RED_OFF and the GREEN_OFF signals are also supplied to the first switch unit 610. Therefore, the BLUE switch BSW1 of the first switch unit may be connected with the ground power source GND, and the RED switch RSW1 and the GREEN switch BSW1 of the first switch unit may be connected with the first voltage VCC.

As a result, the anode of the B OLED of a plurality of the OLEDs in the backlight unit is supplied with the second voltage VCC_B and the cathode thereof is supplied with the ground voltage GND, thereby emitting a predetermined blue light. However, the anodes and the cathodes of the G and R OLEDs are supplied with the second voltage VCC_G and the first voltage VCC, which have the same voltages, so that light is not emitted therefrom.

The backlight driving system for the LCD device having the constitution as above controls the size of a reference voltage applied to the feedback terminal FB of the controller 720 of the light source controller 700 so that the independent power sources for the respective R, G and B OLEDs may be supplied by one DC/DC converter, and the first switch unit 610 and the second switch unit 742 may be controlled by the same signal so that they may easily be controlled in a main chipset, which may be allow reduction in the size of a printed circuit board, routing simplification to support use of electronic manufacturing services and a robust electrostatic discharge design.

Exemplary embodiments of the present invention have been disclosed herein, and although specific terms are employed, they are used and are to be interpreted in a generic and descriptive sense only and not for purpose of limitation. For example, while RGB color model has been discussed, any appropriate color model may be used. If more than three colors are to be used for the color model, an additional switch in both the first and second switch unit, and an additional resistor in the second switch unit may be employed. Accordingly, it will be understood by those of ordinary skill in the art that various changes in form and details may be made without departing from the spirit and scope of the present invention as set forth in the following claims.

What is claimed is:

1. A backlight driving system for driving a backlight unit for a liquid crystal display device using a field sequential driving scheme, the back light unit including a plurality of first color, second color, and third color organic light emitting diodes (OLEDs), the backlight driving system comprising:

a first switch unit including a first color switch, a second color switch, and a third color switch, the first switch unit adapted to selectively supply each of a first voltage and a ground voltage to cathodes of respective first color, second color, and third color OLEDs; and a light source controller adapted to supply independent second voltages, including a first color second voltage, a second color second voltage, and a third color second voltage, to anodes of respective first color, second color, and third color OLEDs, wherein:

the light source controller comprises a DC/DC converter, the DC/DC converter comprises:

a power source voltage booster adapted to boost an input voltage;

a controller adapted to set and store the boosted input voltage as a reference voltage;

a voltage divider adapted to divide the reference voltage into a plurality of output voltages;

a first output stage adapted to supply the divided output voltages to the anode of an OLED; and a second output stage adapted to supply the divided output voltages to the first switch unit connected with the cathode of the OLED, and the voltage divider comprises:

a first resistor provided between a first node and a second node, the first node being connected with the first and second output stages, and the second node being connected with a feedback terminal of the controller; and a second resistor, a third resistor, and a fourth resistor provided between the first resistor and a ground power source, the second, third, and fourth resistors being connected in parallel with each other.

2. The backlight driving system as claimed in claim 1, wherein:

each of the first, second, and third color switches includes first and second switches coupled as a pair of switches, the pair of switches selectively supplying the first voltage and the ground voltage to a cathode of one of the first color, second color, and third color OLEDs, the first switch includes a first electrode coupled to the first voltage, and the second switch includes a first electrode coupled to the ground voltage, and a second electrode coupled to a second electrode of the first switch.

3. The backlight driving system as claimed in claim 1, wherein the light source controller comprises:

three or more resistors connected in parallel, and a second switch unit adapted to respectively connect various ones of the three or more resistors to supply the independent first color, second color, and third color second voltages to the anodes of the respective first color, second color, and third color OLEDs.

4. The backlight driving system as claimed in claim 3, wherein:

first, second, and third control signals are simultaneously applied to the first switch unit and the second switch unit, the first, second, and third control signals correspond to the first color, the second color, and the third color, respectively, and the first, second, and third control signals control the turn on/off of the respective switches included in the first switch unit and the second switch unit.

5. The backlight driving system as claimed in claim 1, wherein the voltage divider further comprises:

a second color second switch between the second resistor and the ground power source to output a power source voltage supplied to the anode of the second color OLED; and a first color second switch between the third resistor and the ground power source to output a power source voltage supplied to the anode of the first color OLED.

6. The backlight driving system as claimed in claim 1, wherein the power source voltage booster comprises an inductor and a diode connected in series.

7. The backlight driving system as claimed in claim 6, wherein the controller receives an input to the inductor and an output from the inductor.

8. The backlight driving system as claimed in claim 1, wherein the light source controller is further adapted to supply independent first, second, and third color second voltages to the first switch unit as the first voltage.

9. The backlight driving system as claimed in claim 8, wherein, when a selected OLED of the first color, second color, and third color OLEDs is to emit light, the first switch unit is adapted to supply the ground voltage to the cathode of the selected OLED.

10. The backlight driving system as claimed in claim 1, wherein the first color is red, the second color is green, and the third color is blue.

11. A backlight system, comprising:

a backlight unit including a plurality of first color, second color, and third color organic light emitting diodes (OLEDs);

a first switch unit including first, second and third color switches, the first switch unit adapted to selectively supply each of a first voltage and a ground voltage to cathodes of respective first color, second color, and third color OLEDs; and a light source controller adapted to supply independent first, second and third color second voltages to anodes of respective first color, second color, and third color OLEDs, wherein:

the light source controller comprises a DC/DC converter, the DC/DC converter comprises:

a power source voltage booster adapted to boost an input voltage;

a controller adapted to set and store the boosted input voltage as a reference voltage;

a voltage divider adapted to divide the reference voltage into a plurality of output voltages;

a first output stage adapted to supply the divided output voltages to the anode of an OLED; and a second output stage adapted to supply the divided output voltages to the first switch unit connected with the cathode of the OLED, and the voltage divider comprises:

a first resistor provided between a first node and a second node, the first node being connected with the first and second output stages, and the second node being connected with a feedback terminal of the controller; and a second resistor, a third resistor, and a fourth resistor provided between the first resistor and a ground power source, the second, third, and fourth resistors being connected in parallel with each other.

12. The backlight system as claimed in claim 11, wherein the first color is red, the second color is green, and the third color is blue.

13. A liquid crystal display (LCD) device, comprising;

a liquid crystal panel; and a backlight system adjacent the liquid crystal panel, the back light system including:

a backlight unit including a plurality of first color, second color, and third color organic light emitting diodes (OLEDs);

a first switch unit including first, second, and third color switches, the first switch unit adapted to selectively supply each of a first voltage and a ground voltage to cathodes of respective first color, second color, and third color OLEDs; and a light source controller adapted to supply independent first, second, and third color second voltages to anodes of respective first color, second color, and third color OLEDs, wherein:

the light source controller comprises a DC/DC converter, the DC/DC converter comprises:

a power source voltage booster adapted to boost an input voltage;

a controller adapted to set and store the boosted input voltage as a reference voltage;

a voltage divider adapted to divide the reference voltage into a plurality of output voltages;

a first output stage adapted to supply the divided output voltages to the anode of an OLED; and a second output stage adapted to supply the divided output voltages to the first switch unit connected with the cathode of the OLED, and the voltage divider comprises:

a first resistor provided between a first node and a second node, the first node being connected with the first and second output stages, and the second node being connected with a feedback terminal of the controller; and a second resistor, a third resistor, and a fourth resistor provided between the first resistor and a ground power source, the second, third, and fourth resistors being connected in parallel with each other.

14. The LCD device as claimed in claim 13, wherein the first color is red, the second color is green, and the third color is blue.

* * * * *